US005725293A

United States Patent [19]

Wilkening et al.

[11] Patent Number: 5,725,293

[45] Date of Patent: Mar. 10, 1998

[54] OVERHEAD STORAGE UNIT

[75] Inventors: Steven R. Wilkening, Grandville, Mich.; Walter B. Herbst, Lake Forest, Ill.; Kurt T. Peterson, Mt. Prospect, Ill.; Aaron B. Eiger, Evanston, Ill.

[73] Assignee: ODL, Incorporated, Zeeland, Mich.

[21] Appl. No.: 694,786

[22] Filed: Aug. 9, 1996

[51] Int. Cl.[6] ..... A47F 5/08

[52] U.S. Cl. ..... 312/248; 248/317; 211/116

[58] Field of Search ..... 312/246, 247, 312/248; 248/317, 318, 320, 322; 211/116, 119

[56] References Cited

U.S. PATENT DOCUMENTS

| | | | |
|---|---|---|---|
| 0,839,749 | 12/1906 | George | 312/248 |
| 3,452,957 | 7/1969 | Zuelsdorf | 248/318 |
| 3,846,005 | 11/1974 | Harper et al. | 312/248 |
| 4,775,201 | 10/1988 | Thomson | 312/248 |
| 5,039,902 | 8/1991 | Schwarz | 312/248 |
| 5,460,280 | 10/1995 | Feddeler | 312/248 |

*Primary Examiner*—Peter M. Cuomo
*Assistant Examiner*—Gerald A. Anderson
*Attorney, Agent, or Firm*—Warner Norcross & Judd

[57] ABSTRACT

The specification discloses a pull-down, storage unit for use in overhead areas. The unit includes a bin and a frame for attaching the bin to a ceiling. The rear of the bin is pivotally suspended from the frame. The front of the bin is releasably secured to the frame by a cable and catch system and may be moved between a raised closed position and a lowered open position. The bin is secured on the frame when closed and suspended on the cables when open.

16 Claims, 2 Drawing Sheets

OVERHEAD STORAGE UNIT

BACKGROUND OF THE INVENTION

The present invention relates to storage systems, and more particularly to "overhead" storage systems suspended from a ceiling.

Many types of residential storage systems have been developed to improve storage efficiency and organization. For example, systems have been specifically designed for under beds or other furniture, for closets, and for garage and utility walls. Storage systems meet a variety of consumer needs.

First, the average household often has little extra space to store items, especially seasonal items, which may be needed only a few times during the year. Infrequently used items may be piled in the garage or basement or placed in stacked boxes, making it difficult to find the items when needed.

Second, storage systems assist consumers in organizing their storage areas to improve accessibility and retrievability.

While existing storage systems provide significant storage enhancement, a continual demand exists for additional storage approaches—particularly nontraditional applications (e.g. other than closet and wall organizers).

SUMMARY OF THE INVENTION

The aforementioned issues are overcome by the present invention wherein a ceiling-mounted, pull-down storage system provides storage space in a garage or basement, thereby utilizing what otherwise might be considered "dead" space. The system includes a frame attached to the ceiling, a bin whose back is pivotally supported on the frame enabling the front to be lowered and raised, a catch system for releasably securing the front of the bin on the frame (i.e. in the closed position), and a cable for limiting how far the front can be lowered from the frame (i.e. in the open position).

The storage system is designed to be mounted on the ceiling, perhaps in a garage or basement, thus creating a place to store items—particularly those which may be required only occasionally.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
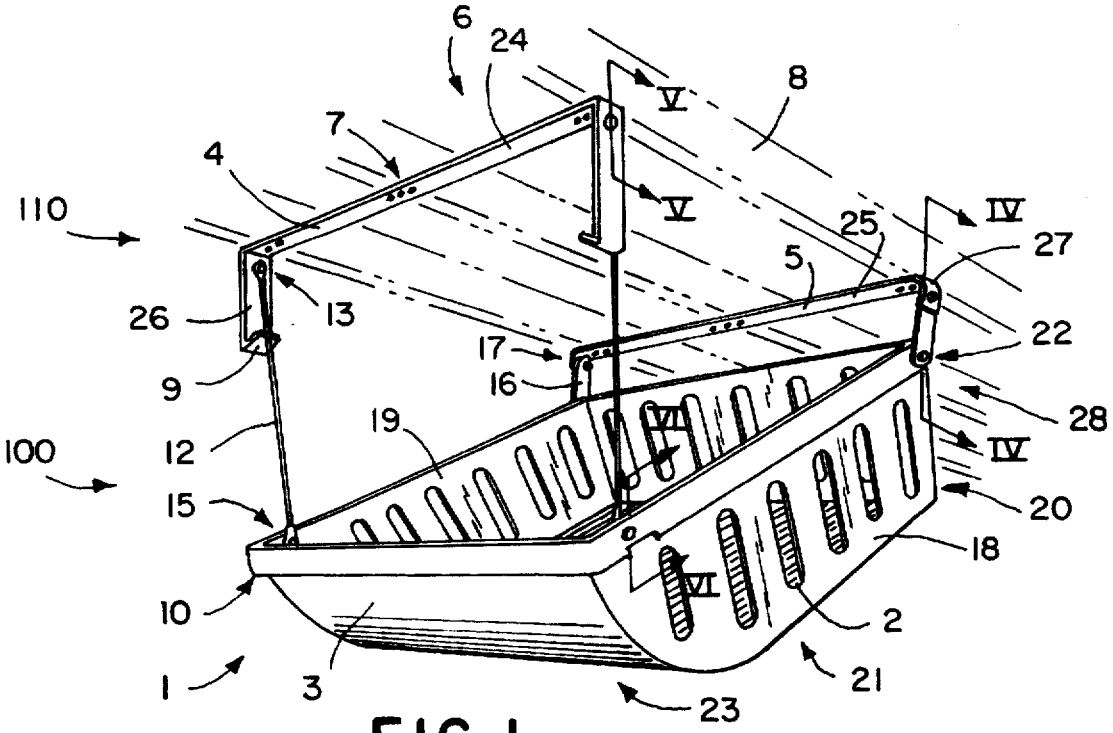
FIG. 1 is a perspective view of the storage system showing the bin in the open position.

A storage unit according to a preferred embodiment of the invention is illustrated in the drawings and generally designated 100. The unit includes a frame 110 and a bin 1 suspended on the frame 110. The rear 20 of the bin 1 is pivotally mounted on the rear bracket 5, and the front 23 of the bin 1 is releasably retained on the front bracket 4. Cables 12 suspend the front 23 of the bin 1 in the open position (see FIG. 1).

Figure 2:
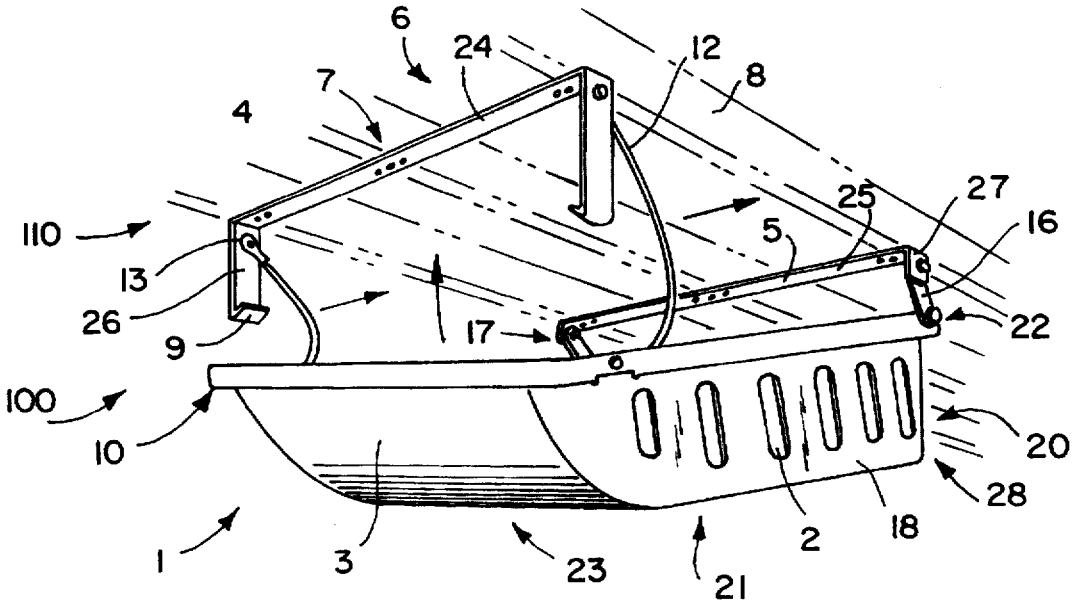
FIG. 2 is a perspective view of the storage system showing the bin partially closed.

The storage unit 100 is mounted to the underside of a surface 6, preferably a ceiling in a garage or basement. The bin 1 is manually raised to and locked in a closed position (FIG. 3) or lowered to and suspended in an open position (FIG. 1). As seen in FIG. 1, the storage unit is easily accessible when open. FIG. 2 shows the unit partially closed, and FIG. 3 shows the unit in a closed and locked position.

I. Bin

Figure 3:
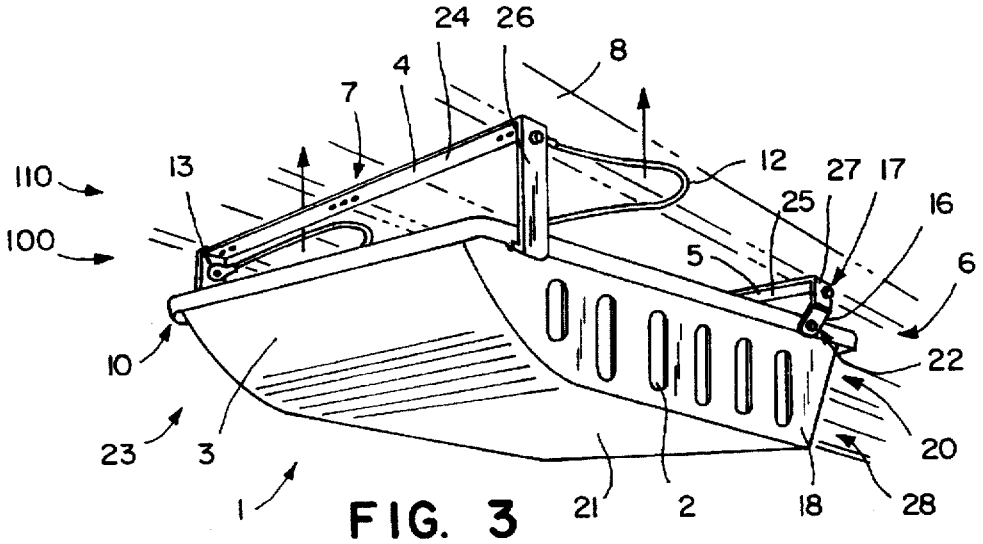
FIG. 3 is a perspective view of the storage system showing the bin in the closed position.

As seen in FIGS. 1, 2, and 3, the storage unit includes a large bin 1, manufactured of structural foam molded plastic, for holding miscellaneous items. The bin 1 includes a bottom 21, a front wall 3, a back wall 28, and left and right side walls 19 and 18, respectively. The bin 1 is open-topped so that items may be piled in the bin 1 or may overhang the sides of the bin 1. As currently designed, the bin 1 is intended to hold approximately 40 pounds of contents.

Along the right and left sides 18 and 19 of the bin 1 and along the back wall 28 of the bin 1 are oblong holes 2. These holes 2 allow one to view the contents of the bin 1 without opening and/or emptying it. In addition, the holes 2 allow for ventilation within the bin 1, thus lessening the possibility of mildew or mustiness.

The front wall 3 of the bin 1 is rounded to give a pleasing appearance. And the bottom 21 of the bin 1 is corrugated to give additional strength to the injection-molded plastic.

A pair of lips 10 extend along the upper edges of the right and left sides 18 and 19, respectively. These lips 10 act similarly to sliders on drawers and allow the bin 1 to slide backwards and forwards on the frame 110 as will be described. In addition, the lips 10 each contain a single detent 11. The detents 11 are small indentations on the bottom sides of the lips 10. The detents 11, which are near the front 23 of the bin 1, act as catch-locks as will be described to hold the bin 1 in the closed position.

II. Frame

As seen in FIGS. 1, 2, and 3, the bin 1 is mounted on a frame, generally designated 110. The frame 110 includes several pieces, including a front bracket 4, a rear bracket 5, and rocker links 16. The front bracket 4 and the rear bracket 5 are adapted to be mounted to the underside of a surface 6, such as a garage or basement ceiling. To facilitate installation, the front and rear brackets 4 and 5 define predrilled holes 7 spaced such that the brackets 4 and 5 may be easily attached to standard joists 8. In addition, to provide for joists 8 which may not be at standard spacing, the front and rear brackets 4 and 5 define several additional holes 7 near the standard holes 7.

Figure 4:
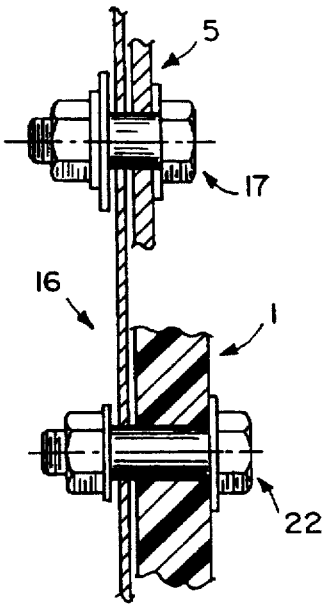
FIG. 4 is a sectional view of the rear linking apparatus taken along line IV—IV in FIG. 1.

The front bracket 4 and the rear bracket 5 have inverted U-shapes each including a horizontal piece 24 and 25, respectively, and a pair of arms 26 and 27, respectively, extending downwardly therefrom. In addition, the front bracket 4 has support flanges 9 turned inwardly towards each other from the arms 26. The support flanges 9 support the bin 1 in the closed position. A pair of rocker links 16 are pivotally attached to the rear bracket 5 by shoulder bolts 17. In addition, each rocker link 16 is connected at its opposite end to the bin 1 by a shoulder bolt 22 (see FIG. 4).

III. Cables and Springs

Figure 5:
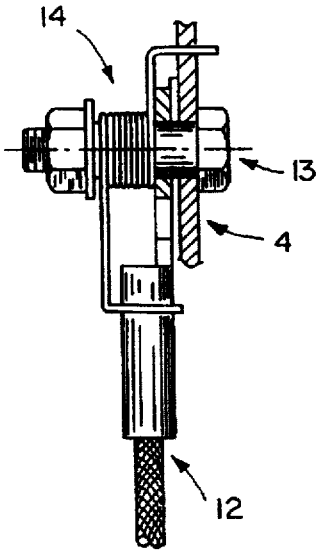
FIG. 5 is a sectional view of the cable and front bracket connection taken along line V—V in FIG. 1.
Figure 6:
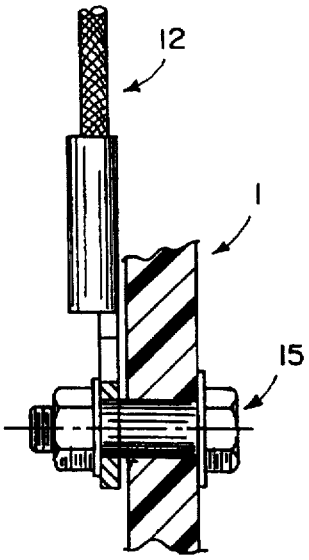
FIG. 6 is a sectional view of the cable and bin connection taken along line VI—VI in FIG. 1.

As seen in FIGS. 5 and 6, a pair of cables 12, each a standard ¼" wire cable, is connected to the front bracket 4 by a shoulder bolt 13 and to the bin 1 by a shoulder bolt 15. The cables 12 suspend the front 23 of the bin 1 in the open position (see FIG. 1). A torsion spring 14 is mounted on each shoulder bolt 13 and is operatively connected to the cable 12 and the front bracket 4 to urge the respective cable 12 upwardly.

IV. Assembly and Operation

All of the storage system components are packaged and sold as an unassembled kit targeted for "do-it-yourselfers." The components are designed for easy installation and assembly.

The frame 110 is mounted to the underside of a surface 6, such as a ceiling, by first attaching the front and rear brackets 4 and 5 to the ceiling. The rocker links 16 are attached to the rear bracket 5. The bin 1 is then slid into the closed position on the front bracket 4, and the bin 1 is attached to the rocker links 16. Finally, the cables 12 are attached top and bottom to the front bracket 4 and bin 1, respectively.

The bin 1 is easily released for access—either for storage or retrieval. The user lifts the bin 1 slightly and lightly pushes the bin 1 so that it slides backwards, thus releasing the support flanges 9 from the detents 11. The bin 1, being in a forward position past equilibrium, easily slides backwards with the lips 10 sliding on the support flanges 9. The user, utilizing the momentum generated by the bin 1 as it begins to slide, pushes the bin 1 back until the lips 10 are released from the support flanges 9. Then, lightly supporting the bin 1, the user lets the bin 1 fall down and forward to the open position as seen in FIG. 1.

As the bin 1 reaches the open position, the cables 12, which are attached to the bin 1, are pulled into their fully extended positions. The cables 12 then hold the front 23 of the bin 1 suspended from the frame 110, and the user has easy access to stored items.

To close the bin 1, so that miscellaneous items are stored, the bin 1 is manually pushed up and back. This pushing action, which relaxes the cables 12, allows the torsion spring 14 to push the cable 12 towards the rear 20 of the bin 1 and out of the way as seen in FIG. 2. In addition, this pushing action causes the rocker link 16 and the bin 1 to rotate about the first shoulder bolt 17, which creates a pivot point. The bin 1 is manually pushed until the lips 10 are higher than the support flanges 9. At that point, the rocker link 16 is close to horizontal, and the bin 1 should be level. The weight of the bin 1 and the miscellaneous items stored in it cause the bin 1 to want to swing forward about the first shoulder bolt 17. While holding the bin 1 level, the user allows it to swing forward. The rocker links 16 and the bin 1 rotate about the first shoulder bolt 17. The support flanges 9 catch the lips 10, and lips 10 and the bin 1 then slide forward on the support flanges 9.

Utilizing the momentum of the bin 1, the user pulls the bin 1 further forward than its equilibrium resting position. In this forward position, the detents 11 then act as catch-locks and catch the support flanges 9, holding the bin 1 stationary in this position past equilibrium. The rocker links 16 are angled forward, showing that the bin 1 is not at equilibrium. As seen in FIG. 3, this is the locked and stored position.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalence.

The embodiment of the claims in which an exclusive property or privilege is claimed are defined as follows:

1. A storage unit comprising:

a bin having a front and a rear;

frame means for suspending said bin from the underside of a horizontal surface, said frame means including pivot means for allowing said rear of said bin to pivot with respect to said frame so that said bin can be raised and lowered about said pivot means, said frame means further including retaining means for selectively retaining said front of said bin, said frame means further including rocker means for allowing said pivot means to move toward or away from said retaining means when said bin is moved between a raised retained position and a raised released position, said retaining means retaining said bin in said raised retained position and releasing said bin in said raised released position.

2. A storage unit as recited in claim 1 wherein said bin comprises a single structural foam molded plastic piece including a rounded front wall, a rear wall, a right side wall, a left side wall, and a bottom.

3. A storage unit as recited in claim 2 wherein at least one of said walls of said bin define apertures for allowing the contents of said bin to be visible from outside said bin.

4. A storage unit as recited in claim 2 wherein said bottom is corrugated thereby increasing the strength of said bottom.

5. A storage unit as recited in claim 2 wherein said left side wall and said right side wall of said bin each include a lip running the length of said walls and extending outwardly away from one another.

6. A storage unit as recited in claim 5 wherein said lips on said left side wall and said right side wall each contain a detent engaging said frame when said bin is in the closed position.

7. A storage unit comprising:

a bin having a front and a rear;

a frame adapted to be mounted to the underside of a horizontal surface, said frame including:

front and rear brackets proximate to said front and said rear, respectively, of said bin;

a pair of linking elements each having opposite ends;

pivot means for pivotally attaching one of said ends of each of said linking elements to said rear bracket and for pivotally attaching the other of said ends of each of said linking elements to said rear of said bin;

a pair of cables; and attachment means for attaching each of said cables to and between said front bracket and said front of said bin; and retaining means for selectively retaining said front of said bin in a raised closed position or a lowered open position.

8. A storage unit as recited in claim 7 wherein said front and rear brackets are each an inverted U-shape having a horizontal piece having opposite ends and two vertical pieces each attached to one of said ends of said horizontal piece.

9. A storage unit as recited in claim 8 wherein said front bracket further includes two horizontal support flanges each extending from one of said vertical pieces inwardly towards one another, said lips on said left side wall and on said right side wall sliding on said horizontal support flanges, said support flanges fitting within said detents in the closed position.

10. A frame as recited in claim 7 wherein said pivot means includes a first shoulder bolt extending through said rear bracket and said linking element and a second shoulder bolt extending through said linking element and said bin.

11. A frame as recited in claim 7 further comprising spring means for lifting said cables upwardly as said bin is raised.

12. A pull-down storage unit of the type to be suspended from a horizontal surface such as a ceiling, said unit comprising:

a frame adapted to be mounted on the horizontal surface, said frame including a pair of rocker arms movable between retained and released positions, said frame further including a retainer portion;

a bin suspended on said frame, said bin including a rear and a front, said rear being pivotally mounted on said rocker arm, said front being slidably mounted on said retainer portion and slidable between a retained position wherein said front is suspended from said retaining portion and a released position wherein said front is released from said retaining portion, said bin and said rocker arms moving together between their respective retained and released positions, whereby said front may be released from said frame to lower said front as said rear of said bin pivots on said frame; and suspension means attached to said frame and said front of said bin for suspending said front of said bin from said frame in an open position when said front of said bin is released from said frame.

13. A storage unit as defined in claim 12 further comprising:

rocker arms permitting said rear of said bin to move with respect to said frame between retained and released positions; and front catch means for releasably retaining said front of said bin on said frame, said catch means retaining said front when said bin is in the retained position, said catch means releasing said front when said bin is in the released position.

14. A storage unit as defined in claim 13 wherein said rocker arms each comprise a rocker link pivotally connected at mutually exclusive points to both said frame and said rear of said bin.

15. A storage unit as defined in claim 13 wherein said front catch means includes a pair of support fingers on said frame; and a pair of lips extending laterally outwardly from said bin and resting on said support fingers in the retained position.

16. A storage unit to be suspended from a horizontal surface such as a ceiling, said unit comprising:

a frame adapted to be mounted on the horizontal surface, said frame including spaced front and rear brackets and a pair of spaced linking elements each having a first end pivotally connected to said rear bracket, said front and rear brackets each being an inverted U-shape, said front bracket including support fingers extending inwardly towards each other;

a bin suspended on said frame, said bin including a rear and a front, said rear being pivotally connected to each of said linking elements at a second end, said front being releasably mounted on said front bracket, whereby said front may be released from said front bracket to lower said front as said rear of said bin pivots on said rear bracket, said bin including lips extending outwardly from one another and sliding on said support fingers as said bin moves backwards and forwards as said linking elements pivot, said linking elements permitting sufficient movement to release said lips from said front bracket as said lips clear said support fingers as said bin slides backwards, said lips on said bin each including a detent, said support fingers cooperating with said detents when said bin is retained on said frame; and suspension means attached to said front bracket and said front of said bin for suspending said bin from said front bracket when said lips are released from said support fingers, said suspension means limiting downward movement of said front of said bin.

* * * * *